US010424862B2

(12) United States Patent
Oishi et al.

(10) Patent No.: US 10,424,862 B2
(45) Date of Patent: Sep. 24, 2019

(54) LOCKING STRUCTURE FOR TERMINALS AND CONNECTOR

(71) Applicants: YAZAKI CORPORATION, Tokyo (JP); HONDA MOTOR CO., LTD., Tokyo (JP)

(72) Inventors: Kozo Oishi, Tochigi (JP); Tomoyuki Miyakawa, Tochigi (JP); Kazuyuki Ochiai, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/029,536

(22) Filed: Jul. 6, 2018

(65) Prior Publication Data

US 2018/0316117 A1 Nov. 1, 2018

Related U.S. Application Data

(63) Continuation of application No. PCT/JP2016/089102, filed on Dec. 28, 2016.

(30) Foreign Application Priority Data

Jan. 7, 2016 (JP) ..... 2016-001917

(51) Int. Cl.
*H01R 13/42* (2006.01)
*H01R 13/422* (2006.01)
(Continued)

(52) U.S. Cl.
CPC ..... *H01R 13/4223* (2013.01); *H01R 13/42* (2013.01); *H01R 13/6272* (2013.01);
(Continued)

(58) Field of Classification Search
CPC . H01R 13/4223; H01R 13/42; H01R 13/6272
(Continued)

(56) References Cited

U.S. PATENT DOCUMENTS 9,231,333 B2 * 1/2016 Endo ..... H01R 13/4223
2014/0193989 A1 * 7/2014 Kutsuna ..... H01R 13/4226 439/155
2014/0364005 A1 12/2014 Yagi et al.

FOREIGN PATENT DOCUMENTS

EP 2 811 581 A1 12/2014
JP 11-238541 A 8/1999
(Continued)

OTHER PUBLICATIONS

International Search Report and Written Opinion of the International Search Report for PCT/JP2016/089102 dated Jan. 31, 2017.
(Continued)

*Primary Examiner* — Alexander Gilman
(74) *Attorney, Agent, or Firm* — Kenealy Vaidya LLP

(57) ABSTRACT

A locking structure for terminals includes a connector housing in which a plurality of terminal housing chambers accommodating the terminals connected to wires are formed and a first lance and a second lance extending from rear end parts of the terminal housing chambers toward front sides thereof to lock the terminals. A first sidewall of a pair of sidewalls forming a first terminal housing chamber is disposed to face a second sidewall of the pair of the sidewalls forming a second terminal housing chamber adjacent to the first terminal housing with a space between the first sidewall and the second sidewall.

7 Claims, 6 Drawing Sheets

(51) Int. Cl.

| | |
|---|---|
| *H01R 13/627* | (2006.01) |
| *H01R 24/20* | (2011.01) |
| *H01R 24/28* | (2011.01) |
| *H01R 103/00* | (2006.01) |
| *H01R 43/22* | (2006.01) |

(52) U.S. Cl.
CPC ..... *H01R 24/20* (2013.01); *H01R 24/28* (2013.01); *H01R 43/22* (2013.01); *H01R 2103/00* (2013.01)

(58) Field of Classification Search
USPC ..... 439/660
See application file for complete search history.

(56) References Cited

FOREIGN PATENT DOCUMENTS

| | | | |
|---|---|---|---|
| JP | 2013-69542 | A | 4/2013 |
| JP | 2014-235989 | A | 12/2014 |
| WO | 2012/133949 | A1 | 10/2012 |

OTHER PUBLICATIONS

Chinese Office Action for the related Chinese Patent Application No. 201680076730.7 dated Mar. 26, 2019.
English language Written Opinion of the International Search Report for PCT/JP2016/089102 dated Jan. 31, 2017.
The extended European search report for the related European patent application No. 16883894.4 dated Oct. 11, 2018.

* cited by examiner

LOCKING STRUCTURE FOR TERMINALS AND CONNECTOR

CROSS REFERENCE TO RELATED APPLICATIONS

This application is a continuation of PCT application No. PCT/JP2016/089102, which was filed on Dec. 28, 2016 based on Japanese Patent Application (No. 2016-001917) filed on Jan. 7, 2016, the contents of which are incorporated herein by reference.

BACKGROUND OF THE INVENTION

Field of the Invention

The present invention relates to a locking structure for terminals housed in a connector housing, and a connector having the locking structure.

Description of Related Art

A terminal pullout structure of a connector is proposed in Patent Literature 1 in which, in a connector housing that includes a plurality of terminal housing chambers in which terminals are housed and lances locking the terminals housed in the terminal housing chambers and is formed of a resin, a terminal pullout jig is inserted into each of the terminal housing chambers to spread out the lances, and a locked state of the terminal is released to pull out the terminal. To be specific, it is proposed that the terminal pullout jig is inserted from a jig insertion chamber formed at an inlet side into which counterpart terminals of the terminal housing chambers are inserted, a tip part of the terminal pullout jig is pressed to a releasing wall part for the terminal housing chambers and is spread outward, the lances continuous with the releasing wall part are displaced up to an unlocking position, and thereby the locked state is released to pull out the terminal.

CITATION LIST

Patent Literature

[Patent Literature 1] JP-A 2013-69542

SUMMARY OF INVENTION

Technical Problem

However, according to the terminal pullout structure disclosed in Patent Literature 1, only one terminal can be pulled out by single work of inserting the terminal pullout jig (the unlocking jig) into the terminal housing chambers. For this reason, for example, when all the terminals are pulled out of the connector housing in which the numerous terminal housing chambers are formed, work of inserting the terminal pullout jigs into the terminal housing chambers in proportion to the number of terminal housing chambers is required. Especially in a small connector housing, there is problem that a work burden is very increased.

The invention is contrived in view of such problems, and an object thereof is to provide a locking structure for terminals capable of reducing work of pulling the terminals from terminal housing chambers.

Solution to Problem

To resolve the above technical problem, a locking structure for terminals of the present invention includes: a connector housing in which a plurality of terminal housing chambers housing the terminals to which wires are connected are formed, and lances that extend from rear end parts of the terminal housing chambers toward front sides thereof to lock the terminals. Sidewalls forming the terminal housing chambers are disposed to face each other with a space between the sidewalls forming the terminal housing chambers adjacent to each other. The two sidewalls disposed to face each other include arms that are elastically deformable in a direction in which the sidewalls are raised and act as parts of the sidewalls. The arms are connected by a connecting part, and the lances are supported by the arms that are parts of the sidewalls of the terminal housing chambers in which the lances are provided.

According to this configuration, since the sidewalls of the neighboring terminal housing chambers which are disposed to face each other have the arms that can be elastically deformed toward a ceiling side (in a direction in which the sidewalls are raised), and the connecting part that is supported across the arms, the connecting part is raised, so that the arms of both of the sidewalls are raised, and the lances supported by the arms are displaced. That is, locked states of the terminals housed in the neighboring terminal housing chambers are released by a single operation of raising the connecting part, and the two terminals can be pulled out. For this reason, work of pulling the terminals out of the terminal housing chambers can be reduced. A jig can be used for work of raising the arms.

In this case, slits extending from rear ends toward front sides may be formed in the two sidewalls disposed to face each other, and the arms may be parts of the sidewalls located above the slits in the direction in which the sidewalls are raised. According to this configuration, since the arms are formed at the ceiling sides of the sidewalls by the slits, a degree of freedom of design for the arms can be increased, and structures of the sidewalls can be simplified.

Ribs that protrude from the arms toward the lances and extend toward front sides may be connected to the two sidewalls disposed to face each other, and the lances may be supported by the arms via the ribs. According to this configuration, since the front sides of the lances can be supported by the ribs, supporting forces of the lances caused by the sidewalls can be reinforced, and locking forces of the terminals caused by the lances can be improved.

The two sidewalls disposed to face each other may be connected by a bottom plate that forms the space along with the sidewalls, and by the connecting part that is located to face the bottom plate, and a surface of the connecting part which faces the bottom plate may be formed such that a tip part of an unlocking jig inserted into the space is allowed to come into contact therewith.

That is, the tip part of the unlocking jig inserted into the space between the sidewalls is inserted between the bottom plate and the connecting part, and the unlocking jig is inclined such that the tip part thereof comes into contact with the connecting part. Thereby, a region in which the tip part of the unlocking jig comes into contact with the connecting part is set to a point of action, and a region in which the unlocking jig comes into contact with the bottom plate is set to a fulcrum, so that the connecting part can be easily raised by the principle of leverage.

Advantageous Effects of the Invention

According to the present invention, a locking structure for terminals capable of reducing work of pulling terminals out of terminal housing chambers can be provided.

DESCRIPTION OF EMBODIMENTS

Figure 1:
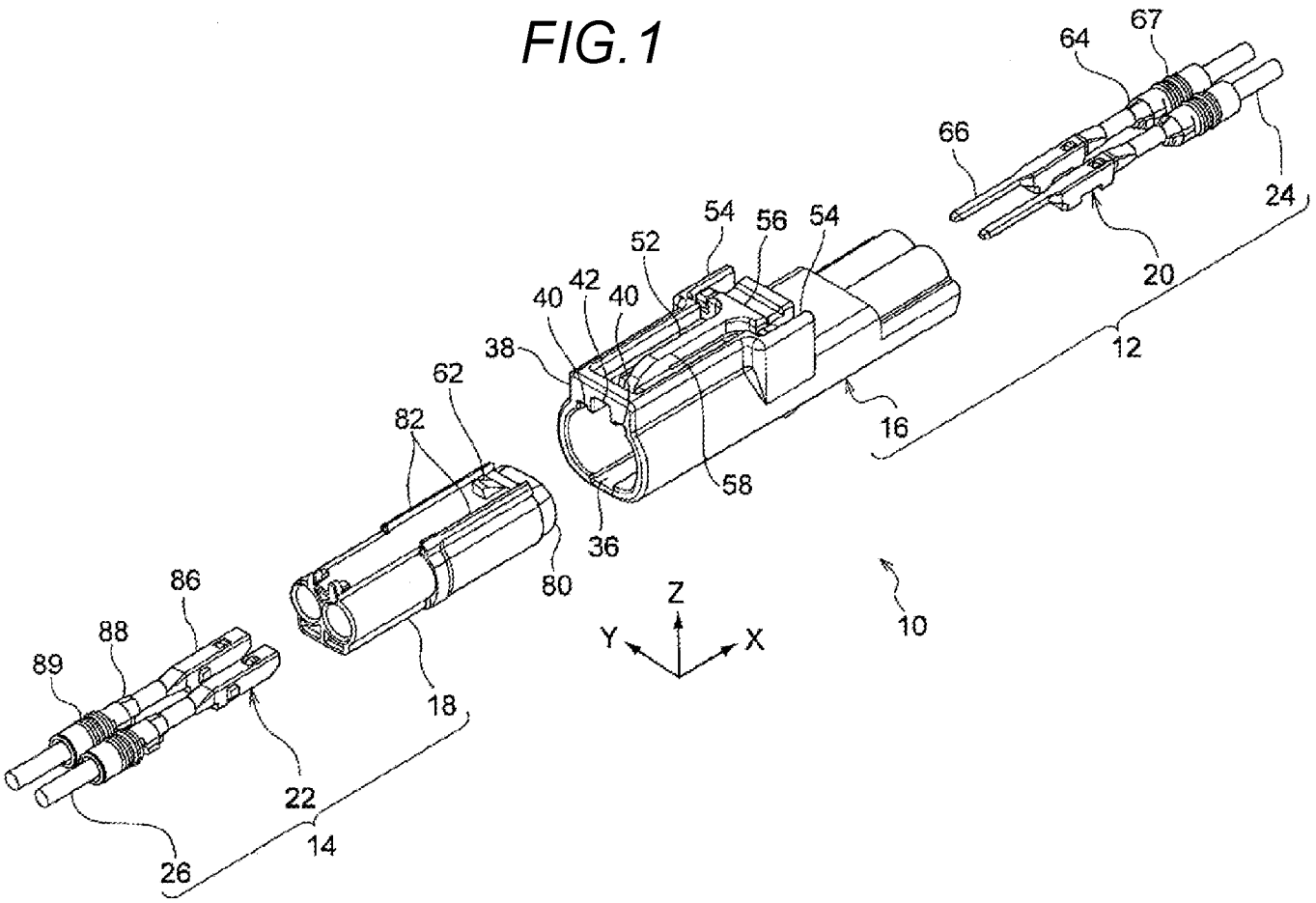
FIG. 1 is an exploded perspective view of a waterproof connector to which the present invention is applied.
Figure 2:
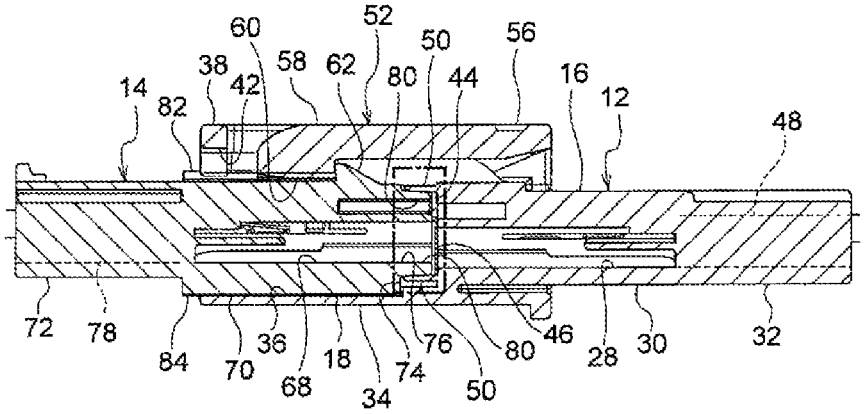
FIG. 2 is a sectional view illustrating a fitted state of the waterproof connector to which the present invention is applied.

Hereinafter, an embodiment of a waterproof connector to which the present invention is applied will be described with reference to the drawings. FIG. 1 is an exploded perspective view of a waterproof connector, and FIG. 2 is a sectional view illustrating a fitted state of the waterproof connector. In FIG. 2, a terminal is omitted to avoid complication of the figure. As illustrated in FIG. 1, the waterproof connector 10 is made up of a male connector 12 and a female connector 14. A male housing 16 of the male connector 12 and a female housing (a connector housing) 18 of the female connector 14 are fitted with each other, and thereby male terminals 20 housed in the male housing 16 and female terminals 22 housed in the female housing 18 are electrically connected to each other. The female housing 18 is configured to be locked in the male housing 16 in a state in which it is fitted into the male housing 16. In the present embodiment, an example in which a locking structure for terminals of the present invention is applied to the female housing 18 will be described, but the locking structure for terminals of the present invention can be applied regardless of a male type and a female type. Hereinafter, an X direction of FIG. 1 is referred to as a length direction, a Y direction is referred to as a width direction, a Z direction is referred to as a height direction, fitting directions of both of the housings 16 and 18 are referred to front sides, and an upper side of FIG. 1 is referred to as an upper side.

A plurality of male terminals 20 (two male terminals) to which wires 24 are connected are housed in the male housing 16. A plurality of female terminals 22 (two female terminals) to which wires 26 are connected are housed in the female housing 18. Each of the male housing 16 and the female housing 18 has a plurality of terminal housing chambers (two terminal housing chambers) (to be described below) in which the terminals are housed. Each of the male housing 16 and the female housing 18 needs only to be configured such that a plurality of terminal housing chambers are at least arranged in the width direction, and a plurality of rows of terminal housing chamber may be formed in the height direction.

As illustrated in FIGS. 1 and 2, the male connector 12 includes the male housing 16 formed of an insulating synthetic resin in a cylindrical shape, and the two male terminals 20 housed in the male housing 16 from behind. The male housing 16 has a tubular base 30 in which the two male terminal housing chambers 28 are formed, a wire holder 32 protruding backward from the base 30, and a hood part 34 protruding forward from the base 30, all of which are integrally formed. The hood part 34 is formed in a tubular shape with a circumferential wall continuous with a circumferential wall of the base 30, has a cross section perpendicular to the length direction of an inner circumferential surface thereof in an oblong shape in which the width direction is set as a longitudinal direction, and allows the female housing 18 to be inserted thereinto. The hood part 34 includes a guide groove 36 that extends in the length direction of an inner wall thereof, and a plate-shaped wall part 38 that is raised upward to be flush with a front end face thereof, and the wall part 38 has a pair of first cutout parts 40 that are formed to be cut out upward from a lower end, and a second cutout part 42 that is located inside the first cutout parts 40 and is cut out upward from a lower end.

The male terminal housing chambers 28 are juxtaposed in the width direction of the base 30, and lock the male terminals 20 inserted from behind by means of lances (not shown), each of which extends forward from a ceiling side. Each of the male terminal housing chambers 28 is formed by communication of an opening 46, which is open to a front end face 44 of the base 30 surrounded by the hood part 34 and a through-hole 48 that passes through the wire holder 32 in the length direction. A tubular male-side annular member 50 protruding forward to surround the opening 46 from a circumferential edge of the opening 46 of the front end face 44 is formed inside the hood part 34. The male-side annular member 50 is formed such that a cross section perpendicular to the length direction has an oblong shape in which the width direction is set as a longitudinal direction, is disposed such that an outer circumferential surface thereof is separated from the inner circumferential surface of the hood part 34 throughout the circumferential direction, and a front end face thereof is disposed behind the front end face of the hood part 34.

The male housing 16 includes a lock arm 52 that extends forward and is supported by the base 30 in a cantilever structure. The lock arm 52 has a base end part 56 that is supported across a pair of wall parts 54 erected upward from both sides of the base 30 in the width direction, and an arm part 58 that extends forward from the base end part 56. The lock arm 52 is configured such that a front end part of the arm part 58 can be displaced upward with the base end part 56 as a fulcrum. The wall part 38 rising from a front end part of the hood part 34 runs backward to surround the lock arm 52 and is continuous with the wall part 54.

As illustrated in FIGS. 1 and 2, a lock part 60 protruding downward is formed at a front end lower portion of the arm part 58. When the male housing 16 and the female housing 18 are fitted, a locking part 62 protruding from the outer circumferential surface of the female housing 18 passes through the second cutout part 42 of the male housing 16, elastically displaces the lock part 60, and then is locked on the lock part 60. Thereby, the male housing 16 and the female housing 18 are locked.

As illustrated in FIG. 1, each of the male terminals 20 is formed of a conductive metal sheet, and has a wire connecting part 64 crimping and connecting a core of the wire 24, and a rod-like male tab 66 connected to each of the counterpart female terminals 22, both of which are integrally formed. Each of the male terminals 20 is set to a length at which a tip part of the male tab 66 protrudes from the front end face 44 in a state in which it is locked in each of the male terminal housing chambers 28. An annular rubber stopper 67 is mounted on the wire 24. For this reason, when the male terminals 20 are housed in the male terminal housing chambers 28, a gap between an outer circumferential surface of the wire 24 and an inner circumferential surface of the through-hole 48 of the wire holder 32 is sealed by each of the rubber stoppers 67.

As illustrated in FIGS. 1 and 2, the female connector 14 includes the female housing 18 that is formed of an insulating synthetic resin in a cylindrical shape, and the female terminals 22 that are housed in the female housing 18 from behind. The female housing 18 is formed in a shape in which a cross section perpendicular to the length direction of the outer circumferential surface thereof is nearly similar to the inner circumferential surface of the hood part 34 of the male housing 16, and is configured to be insertable into the hood part 34. The female housing 18 has a base 70 in which the two female terminal housing chambers 68 (the terminal housing chambers) are formed, and a wire holder 72 protruding backward from the base 70, both of which are integrally formed.

The female terminal housing chambers 68 are juxtaposed in the width direction of the female housing 18, and locks the female terminals 22 by means of lances (not shown), each of which extends forward from a ceiling side. Each of the female terminal housing chambers 68 is formed by communication of an opening 76, which is open to a front end face 74 of the base 70 and a through-hole 78 that passes through the wire holder 72 in an axial direction.

A tubular female-side annular member 80 protruding forward to surround the opening 76 from a circumferential edge of the opening 76 of the front end face 74 is formed at the base 70. The female-side annular member 80 has an outer circumferential surface reduced in a stepped shape with respect to an outer circumferential surface of the base 70, has a cross section in a shape that is nearly similar to the inner circumferential surface of the male-side annular member 50, and is formed in a truncated cone shape that tapers off forward.

As illustrated in FIG. 2, the female housing 18 has the locking part 62 that protrudes from an upper surface of the base 70, a pair of projection parts 82 that extend from the upper surface of the base 70 in the length direction, and a stepped part 84 that protrudes from a lower surface of the base 70 and extends in an axial direction. When the female housing 18 is fitted with the male housing 16, the pair of projections 82 passes through the first cutout parts 40 of the male housing 16, and the stepped part 84 is guided in the guide groove 36 of the male housing 16, and thereby the female housing 18 is inserted while being positioned in the male housing 16.

As illustrated in FIG. 1, each of the female terminals 22 is formed of a conductive metal sheet, and has a wire connecting part 86 crimping and connecting a core of the wire 26, and a squarely tubular electric contact part 88 into and to which the male tab 66 of each of the male terminals 20 is connected, both of which are integrally formed. Each of the female terminals 22 is set to a length at which a front end part of the electric contact part 88 does not protrude forward from the opening 76 of the base 70 in a state in which it is housed in each of the female terminal housing chambers 68 and locked to lances and the like. An annular rubber stopper 89 is mounted on the wire 26. For this reason, when the female terminals 22 are housed in the female terminal housing chambers 68, a gap between an outer circumferential surface of the wire 26 and an inner circumferential surface of the through-hole 78 of the wire holder 72 is sealed by each of the rubber stoppers 89.

Figure 3:
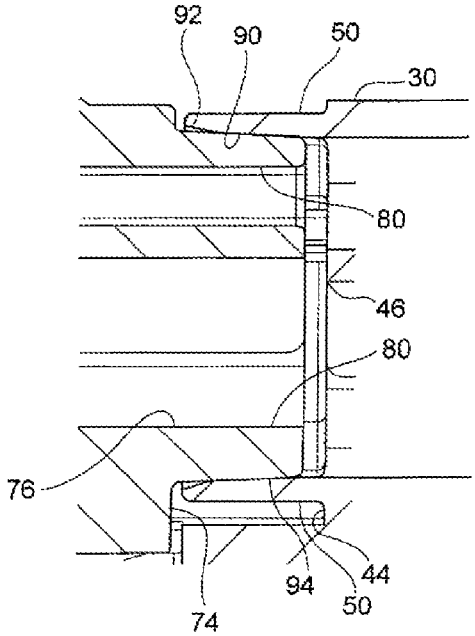
FIG. 3 is an enlarged sectional view illustrating the inside of a frame of FIG. 2.

Here, configurations of the male-side annular member 50 and the female-side annular member 80 will be described. FIG. 3 is an enlarged view of the inside of a frame of FIG. 2. When the male housing 16 and the female housing 18 are fitted, the male-side annular member 50 and the female-side annular member 80 are mutually pressed throughout the circumferential direction, and thereby contact portions of the male terminals 20 and the female terminals 22 are waterproofed. A thickness between the inner and outer circumferential surfaces of the male-side annular member 50 is set to be relatively thin, and the male-side annular member 50 has higher elasticity than the female-side annular member 80. A front end part of the inner circumferential surface 90 of the male-side annular member has an oblique surface 92 that is spread forward. A thickness between the inner and outer circumferential surfaces of the female-side annular member 80 is set to be relatively thick, and the female-side annular member 80 has higher rigidity than the male-side annular member 50. The outer circumferential surface 94 of the female-side annular member 80 is formed in a truncated cone shape that tapers off forward.

In the present embodiment, when the male housing 16 and the female housing 18 are fitted, the female-side annular member 80 is guided into the male-side annular member 50 along the oblique surface 92 of the male-side annular member 50. When the female-side annular member 80 is fitted into the male-side annular member 50, the inner circumferential surface 90 of the male-side annular member 50 is pressed against the outer circumferential surface 94 of the female-side annular member 80 and is elastically deformed, and the inner circumferential surface 90 presses the outer circumferential surface 94 of the female-side annular member 80 due to an elastic restoring force generated at this point. Thereby, the male-side annular member 50 and the female-side annular member 80 come into close contact with each other in a watertight state, and thus prevent water from entering the inside.

Figure 4:
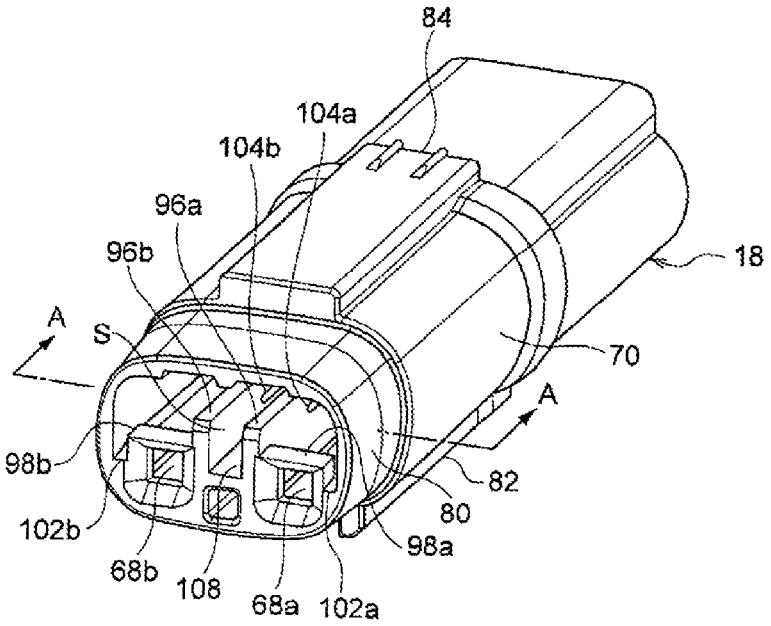
FIG. 4 is an exterior perspective view of a female housing from the front.
Figure 5:
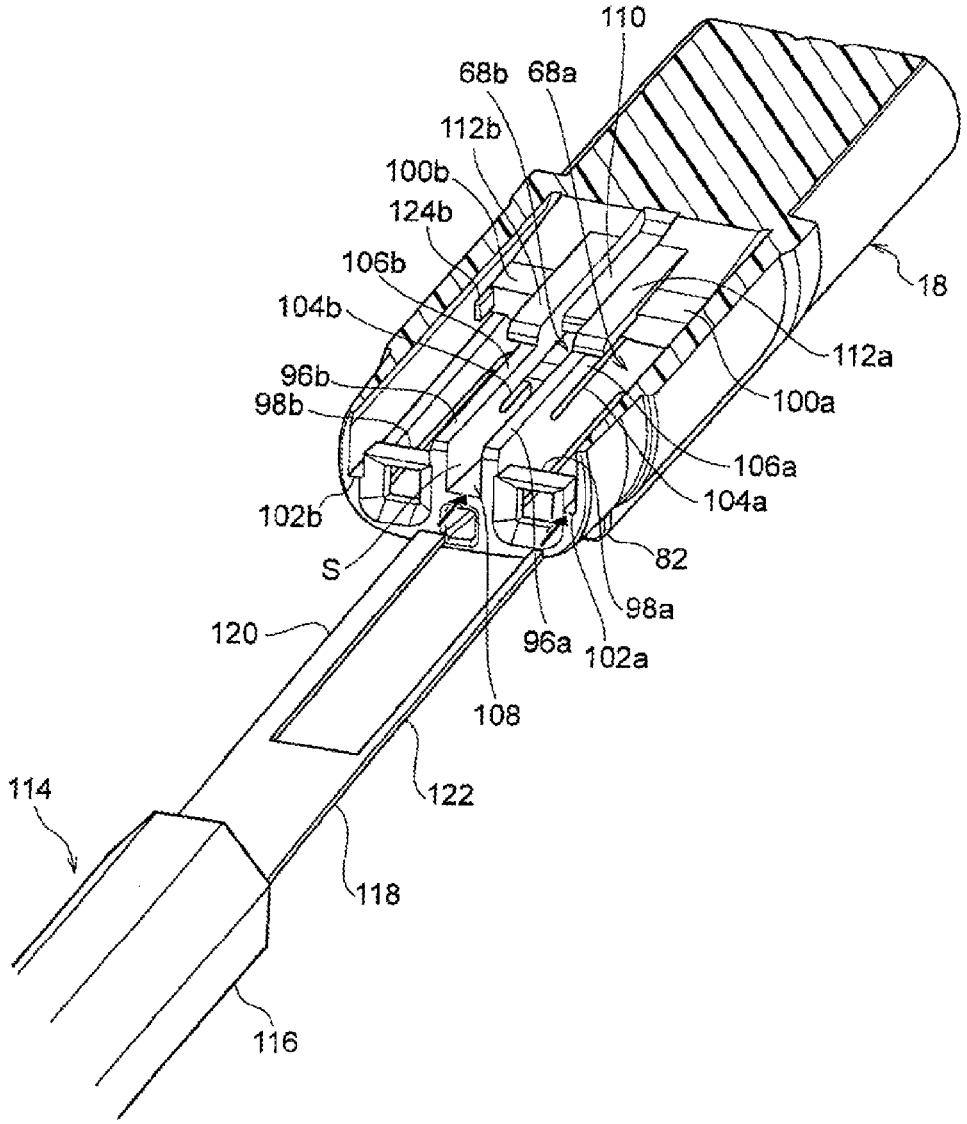
FIG. 5 is a sectional view in a direction of arrow line A-A of FIG. 4.
Figure 6:
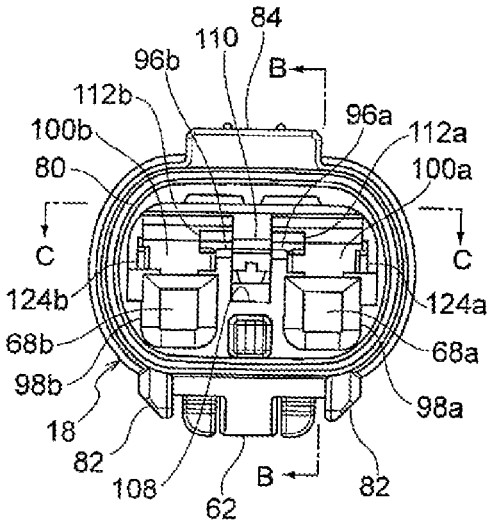
FIG. 6 is a front view of FIG. 4.
Figure 7:
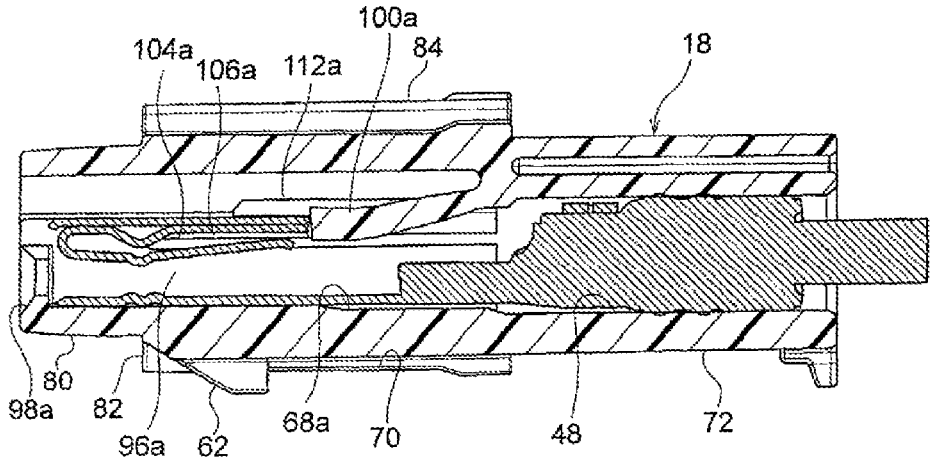
FIG. 7 is a sectional view including female terminals in a direction of arrow line B-B of FIG. 6.
Figure 8:
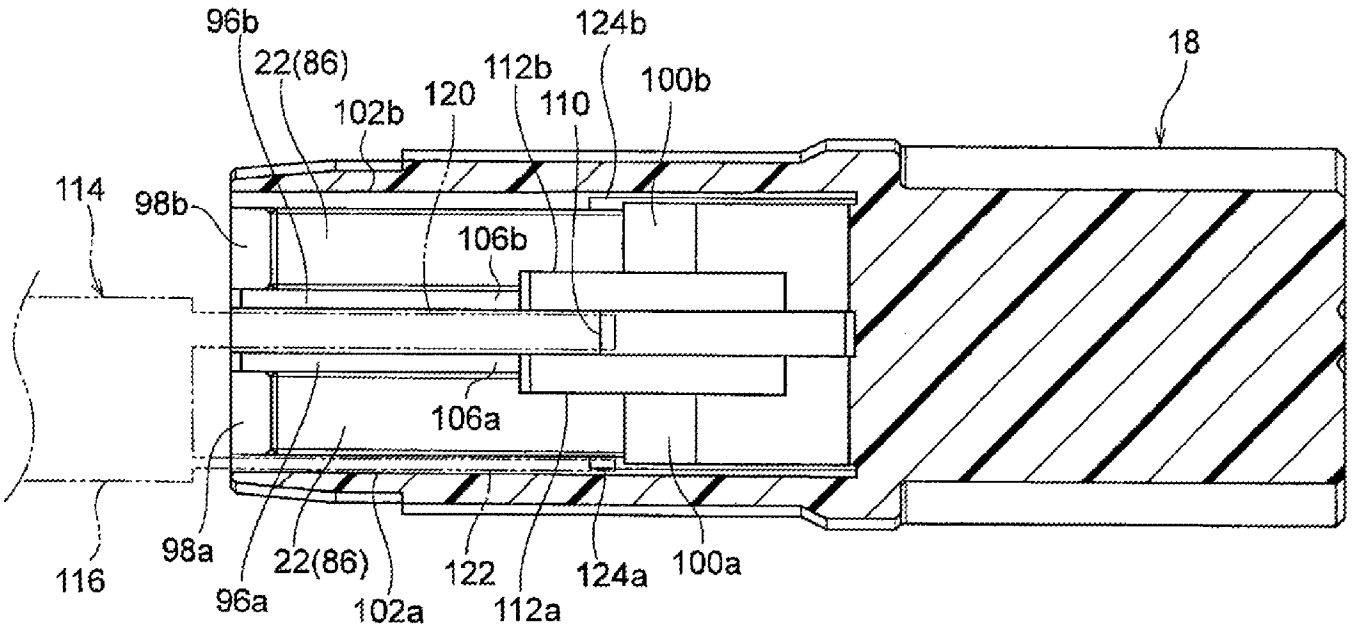
FIG. 8 is a sectional view in a direction of arrow line C-C of FIG. 6

Next, the locking structure for the female terminals 22 which is a characteristic part of the present embodiment will be described with reference to FIGS. 4 to 8. FIG. 4 is an exterior perspective view of the female housing 18 from the front. FIG. 5 is a sectional view in a direction of arrow line A-A of FIG. 4. FIG. 6 is a front view of FIG. 4. FIG. 7 is a sectional view in a direction of arrow line B-B of FIG. 6. FIG. 8 is a sectional view in a direction of arrow line C-C of FIG. 6. The female housing 18 in FIGS. 4 to 7 is turned upside down in FIG. 1. The female terminals 22 are omitted in FIGS. 4 to 6 and 8 to avoid complication of the figure.

As illustrated in FIGS. 4 and 5, the female housing 18 is configured such that the female terminal housing chambers 68 (68*a* and 68*b*) in which the female terminals 22 are housed are juxtaposed inside the base 70 and the female-side annular member 80 in the width direction. The female terminal housing chamber 68*a* is formed such that a sidewall (one sidewall) 96*a* extending toward a front inlet side into which the male tab 66 of each of the male terminals (the counterpart terminals) 20 is inserted is raised from the inner circumferential surface of the female housing 18. The female terminal housing chamber 68*b* is formed such that a sidewall (the other sidewall) 96*b* extending toward the front inlet side into which the male tab 66 of each of the male terminals (the counterpart terminals) 20 is inserted is raised from the inner circumferential surface of the female housing 18. That is, the female terminal housing chambers 68*a* and 68*b* are mutually partitioned and defined by the pair of sidewalls 96*a* and 96*b*, and the sidewall 96*a* and the sidewall 96*b* are disposed to face each other with a space S.

As illustrated in FIGS. 5 to 7, the female terminal housing chambers 68*a* and 68*b* include frame-like front inlet parts 98*a* and 98*b* into which the male terminals 20 are inserted, and lances 100*a* and 100*b* that extend forward from a rear end part of an upper side (a ceiling side. In other words, a direction in which the sidewalls 96*a* and 96*b* are raised) and lock the female terminals 22. The front inlet parts 98*a* and 98*b* are partly supported by the sidewalls 96*a* and 96*b*. The female terminal housing chambers 68*a* and 68*b* are configured such that rail parts 102*a* and 102*b* that extend forward in a stepped shape are formed on the inner circumferential surface of the female housing 18 facing the sidewalls 96*a* and 96*b* in the width direction. Each of the rail parts 102*a* and 102*b* has an inlet part at a gap between each of the front inlet parts 98*a* and 98*b* and the inner circumferential surface of the female housing 18.

The sidewalls 96*a* and 96*b* are disposed with upper end parts raised in the height direction separated from the inner circumferential surface of the female housing 18. The sidewalls 96*a* and 96*b* have slits 104*a* and 104*b* that are cut from a rear end toward a front side in the middle thereof in the height direction. The sidewalls 96*a* and 96*b* have arms 106*a* and 106*b* that are formed on upper sides of the slits 104*a* and 104*b* (the ceiling sides. In other words, the direction in which the sidewalls 96*a* and 96*b* are raised) and can be elastically deformed upward. That is, the arms 106*a* and 106*b* can be displaced to the upper side (the ceiling side) within a range of the gap formed between inner circumferential surface of the female housing 18 by widely opening the slits 104*a* and 104*b*.

As illustrated in FIG. 5, the sidewalls 96*a* and 96*b* are connected to each other by a bottom plate 108 extending to a front side and a connecting part 110 that faces the bottom plate 108 and is located at a deep side (a rear side) opposite to a front side. To be specific, the bottom plate 108 forms the space S along with the sidewalls 96*a* and 96*b*, and is provided to connect lower portions of the sidewalls 96*a* and 96*b* which are below the slits 104*a* and 104*b*, that is, are opposite to the arms 106*a* and 106*b* from a rear end to a front end of each of the sidewalls 96*a* and 96*b*. The connecting part 110 is provided to connect the arms 106*a* and 106*b* at the upper sides of the slits 104*a* and 104*b* (the ceiling side; that is, the direction in which the sidewalls 96*a* and 96*b* are raised) at deep sides of the sidewalls 96*a* and 96*b*. The connecting part 110 is disposed to face the bottom plate 108 with the space S from the bottom plate 108, and can be elastically deformed upward integrally with the arms 106*a* and 106*b*. In FIG. 5, the left and right slits 104*a* and 104*b* are of an asymmetrical shape, and may be symmetrically formed.

The sidewalls 96*a* and 96*b* are supported to be continuous with the lances 100*a* and 100*b* at rear end parts of the arms 106*a* and 106*b*. The lances 100*a* and 100*b* are disposed at the rail parts 102*a* and 102*b* and away from the inner circumferential surface of the female housing 18 across the rail parts 102*a* and 102*b* outside in the width direction, and can be elastically deformed upward (to the ceiling side, that is the direction in which the sidewalls 96*a* and 96*b* are raised) along with the arms 106*a* and 106*b*. Ribs 112*a* and 112*b* extending forward to be continuous with the lances 100*a* and 100*b* are connected to the arms 106*a* and 106*b*. The ribs 112*a* and 112*b* are provided to extend from upper end parts of the arms 106*a* and 106*b* to sides opposite to each other, in other words toward the lances 100*a* and 100*b* in a rectangular shape. Rear end parts of the lances 100*a* and 100*b* are supported by the arms 106*a* and 106*b*. Further, the lances 100*a* and 100*b* are supported on outer sides of the ribs 112*a* and 112*b* in the width direction, and thereby are supported by arms 106*a* and 106*b* via the ribs 112*a* and 112*b*.

The female terminals 22 inserted into the female terminal housing chambers 68*a* and 68*b* from behind elastically displace the lances 100*a* and 100*b* toward the ceiling side (in other words, in the direction in which the sidewalls 96*a* and 96*b* are raised), and are inserted at a predetermined housing position. At this point, the sidewalls 96*a* and 96*b* are configured such that, along with the displacement of the lances 100*a* and 100*b*, gaps of the slits 104*a* and 104*b* in the vertical direction increase, and rear end parts of the arms 106*a* and 106*b* are elastically displaced upward. As illustrated in FIG. 7, rear ends of the electric contact parts 88 are locked on the lances 100*a* and 100*b* that are electrically restored, and thereby backward movement of the female terminals 22 is regulated, and forward movement of the female terminals 22 is regulated by the front inlet parts 98*a* and 98*b*. Thereby, the female terminals 22 are positioned at predetermined positions of the female terminal housing chambers 68*a* and 68*b*.

Rear end parts of the lances 100*a* and 100*b* of the present embodiment are connected to and supported on the arms 106*a* and 106*b* of the sidewalls 96*a* and 96*b*, and furthermore wide ranges up to front end parts via the ribs 112*a* and 112*b* are supported by the arms 106*a* and 106*b*. For this reason, the lances 100*a* and 100*b* are more firmly supported compared to a conventional structure in which only the rear end parts of the lances 100*a* and 100*b* are supported in the female terminal housing chambers 68*a* and 68*b*, and a locking force for the female terminals 22 can be increased.

Next, a structure in which locked states of the female terminals 22 are released in the locking structure for these female terminals 22 will be described. In the locking structure of the present embodiment, the locked states of the female terminals 22 locked on the lances 100*a* and 100*b* are released using a dedicated unlocking jig 114.

As illustrated in FIG. 5, the unlocking jig 114 includes a grip part 116 that is gripped by a worker, and a releasing lug part 118 that straightly protrude from the grip part 116. The releasing lug part 118 is formed to be forked into a first lug part 120 and a second lug part 122, and the first lug part 120 and the second lug part 122 are set to have the same length in a protruding direction. The first lug part 120 is set to be wider than the second lug part 122.

The space S located between the sidewalls 96*a* and 96*b* is formed with a width dimension with which the first lug part 120 can be inserted. A tip part of the first lug part 120 can be inserted into a gap between the connecting part 110 and the bottom plate 108 that are located at a deep side of the space S, and a surface of the connecting part 110 which faces the bottom plate 108 is formed to be able to come into contact with the tip part of the first lug part 120.

Each of the rail parts 102*a* and 102*b* of the female terminal housing chambers 68*a* and 68*b* is formed with a width dimension with which the second lug part 122 can be inserted. Protrusions 124*a* and 124*b* protruding forward from front end parts of the lances 100*a* and 100*b* are provided on upper sides of deep sides of the rail parts 102*a* and 102*b*. The protrusions 124*a* and 124*b* are formed such that a tip upper surface of the second lug part 122 inserted along each of the rail parts 102*a* and 102*b* can come into contact.

Next, work of unlocking the female terminals 22 locked on the female connector 14 will be described. As indicated by an arrow of FIG. 5, the first lug part 120 of the unlocking jig 114 is inserted into the space S, and the second lug part 122 of the unlocking jig 114 is inserted along the rail part 102*a*. Thereby, as illustrated in FIG. 8, a tip part of the first lug part 120 of the unlocking jig 114 is inserted into the gap between the connecting part 110 and the bottom plate 108, and a tip part of the second lug part 122 of the unlocking jig 114 is inserted into a gap between the protrusion 124*a* and the rail part 102*a*.

Then, the unlocking jig 114 is inclined such that the tip part of the first lug part 120 comes into contact with a lower surface of the connecting part 110 facing the bottom plate 108. Thereby, in the unlocking jig 114, the tip part of the first lug part 120 which comes into contact with the connecting part 110 becomes a point of action, and a base end part of the first lug part 120 which comes into contact with the bottom plate 108 becomes a fulcrum, so that the connecting part 110 is easily raised by the principle of leverage.

When the connecting part 110 is raised in this way, the arms 106*a* and 106*b* of both of the sidewalls 96*a* and 96*b* are raised in conjunction with the connecting part 110, and the lances 100*a* and 100*b* supported by the arms 106*a* and 106*b* are displaced toward the ceiling side. Thereby, locking caused by the lances 100*a* and 100*b* of the female terminals 22 housed in the neighboring terminal housing chambers 68*a* and 68*b* is released by a single operation of raising the connecting part 110, and the two female terminals 22 can be pulled out. For this reason, work of pulling the female terminals 22 out of the terminal housing chambers 68*a* and 68*b* can be reduced.

In the case of the present embodiment, the tip part of the second lug part 122 of the unlocking jig 114 comes into contact with the protrusion 124*a* according to the inclination of the first lug part 120. For this reason, the tip part of the second lug part 122 of the unlocking jig 114 becomes a point of action, and a base end part of the second lug part 122 which comes into contact with the rail part 102*a* becomes a fulcrum, so that the lance 100*a* can also be raised from an outside opposite to the arm 106*a* in the width direction by the principle of leverage. Thereby, the lance 100*a* can be raised in a well balanced manner.

The second lug part 122 of the unlocking jig 114 is inserted along the rail part 102*a*, but it may be configured to be inserted along the rail part 102*b*. Since the unlocking jig 114 can simultaneously release the locked states of the two female terminals 22 as long as at least the connecting part 110 can be raised, the second lug part 122 can be omitted if the unlocking jig 114 has the first lug part 120. Thereby, since the configuration of the unlocking jig 114 is simplified, a general-purpose jig can be used.

In the present embodiment, since the locked states of the two female terminals 22 can be simultaneously released only by inserting the first lug part 120 into the space S between the sidewalls 96*a* and 96*b* that partition the neighboring female terminal housing chambers 68*a* and 68*b*, the entire unlocking structure is simplified, and the female connector 14 can be downsized. In the present embodiment, the rail parts 102*a* and 102*b* into which the second lug part 122 is inserted are provided inside the female housing 18. However, since the rail parts 102*a* and 102*b* are provided using the spaces between the female terminals 22 housed in the female terminal housing chambers 68*a* and 68*b* and the inner circumferential surface of the female housing 18, an influence is not exerted on a size of the female connector 14.

While the embodiment to which the present invention is applied has been described, this is merely a representative example, and the present invention can be carried out in various modes without departing from the spirit thereof.

For example, in the present embodiment, the example in which the slits 104*a* and 104*b* are formed in the sidewalls 96*a* and 96*b* and the arms 106*a* and 106*b* are formed above the slits 104*a* and 104*b* has been described. However, the arms 106*a* and 106*b* may use, for instance, protrusions, which protrude from the rear end parts of the sidewalls 96*a* and 96*b* toward rear sides (deep sides) thereof in a cantilever shape, in place of the slits 104*a* and 104*b*.

Here, features of the embodiments of the aforementioned locking structure for terminals and the connector according to the present invention are concisely arranged and listed on (1) to (5) below.

(1) A locking structure for terminals including a connector housing (a female housing) in which a plurality of terminal housing chambers (68*a* and 68*b*) accommodating the terminals (22) connected to wires (26) are formed, and a first lance and a second lance (100*a* and 100*b*) extending from rear end parts of the terminal housing chambers toward front sides thereof to lock the terminals, wherein first sidewall of a pair of sidewalls (96*a* and 96*b*) forming a first terminal housing chamber is disposed to face a second sidewall of the pair of the sidewalls forming a second terminal housing chamber adjacent to the first terminal housing with a space (S) between the first sidewall and the second sidewall, wherein the first sidewall and the second sidewall include a first arm and a second arm (106*a* and 106*b*) each extends like a cantilever toward a rear side with a front end as a fixed end, and that are elastically deformable in a direction in which the first arm and the second arm rise as parts of the first sidewall and the second sidewall, wherein the first arm and the second arm are connected by a connecting part (110) and the connecting part is movable integrally with the first arm and the second arm in the direction in which the first sidewall and the second sidewall rise, and wherein the first lance and the second lance are respectively supported by the first arm and the second arm that are parts of the first sidewall and the second sidewall of the first terminal housing chamber and the second terminal housing chamber in which the first lance and the second lance are respectively provided.

(2) The locking structure for the terminals according to (1), wherein the first sidewall and the second sidewall include a first slit and a second slit (104*a* and 104*b*) extending from rear ends toward front sides, and wherein the first arm and the second arm are parts of the first sidewall and the second sidewall located above the first slit and the second slit in the direction in which the first sidewall and the second sidewall rise.

(3) The locking structure for the terminals according to (1) or (2), wherein a first rib and a second rib (112*a* and 112*b*) protruding from the first arm and the second arm toward the first lance and the second lance and extending toward front sides are connected to the first sidewall and the second sidewall, and wherein the first lance and the second lance are respectively supported by the first arm and the second arm via the first rib and the second rib.

(4) The locking structure for the terminals according to any one of (1) to (3), wherein the first sidewall and the second sidewall are connected by a bottom plate (108) forming the space along with the first sidewall and the second sidewall, and by the connecting part located to face the bottom plate, and wherein a surface of the connecting part facing the bottom plate is formed such that a tip part of an unlocking jig (114) inserted into the space is allowed to come into contact therewith.

(5) A connector (14) having the locking structure for terminals according to any one of (1) to (4).

The present invention has been described in detail and with reference to a specific embodiment. However, it is apparent to those skilled in the art that the present invention can be variously modified or altered without departing from the spirit and scope of the present invention.

This application is based on Japanese Patent Application No. 2016-1917, filed on Jan. 7, 2016, the content of which is incorporated herein by reference.

INDUSTRIAL APPLICABILITY

According to the locking structure for terminals of the present invention, work of pulling the terminals out of the terminal housing chambers can be reduced. The present invention having this effect is useful for a locking structure for terminals housed in the connector housing and a connector having the locking structure.

REFERENCE SIGNS LIST

10: Waterproof connector
14: Female connector (connector)
18: Female housing (connector housing)
22: Female terminal (terminal)
26: Wire
68*a*, 68*b*: Female terminal housing chamber (terminal housing chamber)
96*a*: Sidewall (one sidewall)
96*b*: Sidewall (other sidewall)
S: Space
100*a*, 100*b*: Lance
104*a*, 104*b*: Slit
106*a*, 106*b*: Arm
108: Bottom plate
110: Connecting part
112*a*, 112*b*: Rib
114: Unlocking jig

What is claimed is:

1. A locking structure for terminals comprising:

a connector housing in which a plurality of terminal housing chambers accommodating the terminals connected to wires are formed; and a first lance and a second lance extending from rear end parts of the terminal housing chambers toward front sides thereof to lock the terminals, wherein a first sidewall of a pair of sidewalls forming a first terminal housing chamber is disposed to face a second sidewall of the pair of the sidewalls forming a second terminal housing chamber adjacent to the first terminal housing with a space between the first sidewall and the second sidewall, wherein the first sidewall and the second sidewall include a first arm and a second arm each extends like a cantilever toward a rear side with a front end as a fixed end, and the first arm and the second arm are elastically deformable in a direction in which the first sidewall and the second sidewall rise as parts of the first sidewall and the second sidewall, wherein the first arm and the second arm are connected by a connecting part and the connecting part is movable integrally with the first arm and the second arm in the direction in which the first sidewall and the second sidewall rise, and wherein the first lance and the second lance are respectively supported by the first arm and the second arm that are parts of the first sidewall and the second sidewall of the first terminal housing chamber and the second terminal housing chamber in which the first lance and the second lance are respectively provided.

2. The locking structure for the terminals according to claim 1, wherein the first sidewall and the second sidewall include a first slit and a second slit extending from rear ends toward front sides, and wherein the first arm and the second arm are parts of the first sidewall and the second sidewall located above the first slit and the second slit in the direction in which the first sidewall and the second sidewall rise.

3. A connector having the locking structure for terminals according to claim 1.

4. A locking structure for terminals comprising:

a connector housing in which a plurality of terminal housing chambers accommodating the terminals connected to wires are formed; and a first lance and a second lance extending from rear end parts of the terminal housing chambers toward front sides thereof to lock the terminals, wherein a first sidewall of a pair of sidewalls forming a first terminal housing chamber is disposed to face a second sidewall of the pair of the sidewalls forming a second terminal housing chamber adjacent to the first terminal housing with a space between the first sidewall and the second sidewall, wherein the first sidewall and the second sidewall include a first arm and a second arm respectively that are elastically deformable in a direction in which the first sidewall and the second sidewall rise as parts of the first sidewall and the second sidewall, wherein the first arm and the second arm are connected by a connecting part, wherein the first lance and the second lance are respectively supported by the first arm and the second arm that are parts of the first sidewall and the second sidewall of the first terminal housing chamber and the second terminal housing chamber in which the first lance and the second lance are respectively provided, wherein a first rib and a second rib protruding from the first arm and the second arm respectively, toward the first lance and the second lance, respectively, and extending toward front sides are connected to the first sidewall and the second sidewall, respectively, wherein the first lance and the second lance are respectively supported by the first arm and the second arm via the first rib and the second rib, wherein the direction in which the first sidewall and the second sidewall rise coincides with a direction to which the first lance and the second lance elastically deform for unlocking the terminals, and wherein locked states of the terminals housed in the neighboring first and second terminal housing chambers are configured to be released by a single operation of raising the connecting part so that the two terminals are pulled.

5. A connector having the locking structure for terminals according to claim 4.

6. A locking structure for terminals comprising:

a connector housing in which a plurality of terminal housing chambers accommodating the terminals connected to wires are formed; and a first lance and a second lance extending from rear end parts of the terminal housing chambers toward front sides thereof to lock the terminals, wherein a first sidewall of a pair of sidewalls forming a first terminal housing chamber is disposed to face a second sidewall of the pair of the sidewalls forming a second terminal housing chamber adjacent to the first terminal housing with a space between the first sidewall and the second sidewall, wherein the first sidewall and the second sidewall include a first arm and a second arm respectively that are elastically deformable in a direction in which the first sidewall and the second sidewall rise as parts of the first sidewall and the second sidewall, wherein the first arm and the second arm are connected by a connecting part, wherein the first lance and the second lance are respectively supported by the first arm and the second arm that are parts of the first sidewall and the second sidewall of the first terminal housing chamber and the second terminal housing chamber in which the first lance and the second lance are respectively provided, wherein the first sidewall and the second sidewall are connected by a bottom plate forming the space along with the first sidewall and the second sidewall, and by the connecting part located to face the bottom plate, wherein a surface of the connecting part facing the bottom plate is formed such that a tip part of an unlocking jig comes into contact with the surface of the connecting part when the unlocking jig is inserted into the space, wherein the direction in which the first sidewall and the second sidewall rise coincides with a direction to which the first lance and the second lance elastically deform for unlocking the terminals, and wherein locked states of the terminals housed in the neighboring first and second terminal housing chambers are configured to be released by a single operation of raising the connecting part so that the two terminals are pulled out.

7. A connector having the locking structure for terminals according to claim 6.

* * * * *